US005331689A

United States Patent [19]

Haq

[11] Patent Number: 5,331,689

[45] Date of Patent: Jul. 26, 1994

[54] PORTABLE URINAL

[76] Inventor: Anwar Haq, 26342-3A Forest Ridge Dr., Lake Forest, Calif. 90630

[21] Appl. No.: 46,745

[22] Filed: Apr. 16, 1993

[51] Int. Cl.[5] ..... A47K 11/12

[52] U.S. Cl. ..... 4/144.1; 128/760; 128/762; 604/317; 604/326

[58] Field of Search ..... 4/144.1, 144.2, 144.3, 4/144.4; 128/760, 761, 762, 763, 766, 767; 141/2, 18, 21, 337; 222/450; 73/863.71; 604/317, 319, 321, 326

[56] References Cited

U.S. PATENT DOCUMENTS

| | | | |
|---|---|---|---|
| 3,415,299 | 12/1968 | Hinman, Jr. et al. | 604/326 |
| 3,703,731 | 11/1972 | Leiser | 4/144.3 |
| 3,906,935 | 9/1975 | Raia et al. | 128/762 |
| 4,057,062 | 11/1977 | Lavigne | 604/326 |
| 4,121,306 | 10/1978 | Bringman et al. | 4/144.2 |
| 4,244,061 | 1/1981 | Webster et al. | 4/144.1 |
| 4,495,951 | 1/1985 | Kenda | 128/762 |
| 4,813,931 | 3/1989 | Hauze | 128/760 |
| 4,823,622 | 4/1989 | Nohl et al. | 73/863.71 |
| 5,010,599 | 4/1991 | Nilsson | 604/317 |
| 5,020,702 | 1/1991 | James | 141/337 |
| 5,211,642 | 5/1993 | Clendenning | 604/317 |

FOREIGN PATENT DOCUMENTS

| | | | |
|---|---|---|---|
| 3206246 | 8/1988 | Japan | 4/144.1 |

*Primary Examiner*—Henry J. Recla
*Assistant Examiner*—Charles R. Eloshway

[57] ABSTRACT

A portable urinal apparatus comprises a urine-receiving member having an inlet and an outlet, the inlet being sized and shaped for receiving a flow of urine from an individual using the apparatus. A first flexible fluid conduit has an inlet end and an outlet end, the inlet end being detachably connected to the outlet of the urine receiving member, the outlet end having a male quick-disconnect fitting. A valve is provided that has an inlet and an outlet, the inlet being connected to the outlet end of the first flexible conduit, the inlet and outlets having female quick disconnect fittings. A second flexible fluid conduit has an inlet end and an outlet end, the inlet end of the second conduit having a male quick-disconnect fitting which mates with the quick-disconnect fitting at the outlet of the valve. Included is a urine specimen container that has a male quick-disconnect fitting at the inlet thereof which mates with the female quick-disconnect fitting at the outlet of the valve, the specimen container being thereby connectable to the outlet of the valve in place of the second conduit. A urine collecting receptacle has a fluid inlet region to which the outlet end of the second conduit is detachably connected. A screen is disposed between the urine receiving member and the first conduit for catching and retaining foreign material in the flow of urine from the urine receiving member.

2 Claims, 2 Drawing Sheets

PORTABLE URINAL

BACKGROUND OF THE INVENTION

1. Field of the Invention

The present invention relates generally to the field of portable urinals and, more particularly, to the field of portable urinals adapted for use in sick rooms, hospitals, campers, travel trailers and/or for use by handicapped or partially immobilized individuals.

2. Background Discussion

As long as an individual remains alive, there exists the necessity that the individual periodically relieve himself or herself by urinating. For most individuals this bodily function, while often a nuisance, is of no special consequence.

This is not, however, the situation for individuals confined to bed or a wheelchair and for those who are either not ambulatory or, for some reason or another, have great difficulty moving about. For such individuals, the task of relieving himself or herself is usually a trying and complicated process, often requiring the assistance of others and not infrequently engendering in the individual a sense of helplessness, inferiority and dependency.

Some efforts have been made to alleviate this problem. U.S. Pat. No. 4,955,922 to Terauchi, for example, discloses a urine collector for a wheel chair and U.S. Pat. No. 4,164,795 to Johnson discloses a portable urinal, as does U.S. Pat. No. 5,010,599 to Nilsson. While such urinals as are disclosed in these patents are considered to be useful, they do not completely solve the problem of many individuals. As an illustration, the portable urinals disclosed in the above-referenced Johnson and Nilsson patents are considered to have a limited fluid capacity and may be difficult for some individuals to use in an easy and sanitary manner.

An associated problem is that some individuals having to use a portable urinal, such as those disclosed in the patents mentioned above, are required, because of the nature of their infirmity or other health problem, to frequently collect urine specimens for analysis. To the knowledge of the present inventor, there are no portable urinals that enable the collecting of urine specimens in a clean, sanitary and easy manner.

For these and other reasons, the present inventor has invented an improved portable urinal that not only is easy and convenient to use in a wide variety of applications but also enables the easy and sanitary collecting of urine sample.

SUMMARY OF THE INVENTION

In accordance with the present invention, a portable urinal apparatus comprises a urine-receiving member having an inlet and an outlet, the inlet being sized and shaped for receiving a flow of urine from an individual using the apparatus. Included in the apparatus is a first flexible fluid conduit having an inlet end and an outlet end, the inlet end being detachably connected to the outlet of the urine-receiving member. A valve is provided which has an inlet and an outlet, the outlet end of the first flexible fluid conduit being detachably connected to the valve inlet. Further comprising the apparatus are a second flexible fluid conduit having an inlet end and an outlet end, the inlet end of the second conduit being detachable connected to the outlet of the valve, and a urine collecting receptacle having a fluid inlet region, the outlet end of the second conduit being detachably connected to the receptacle fluid inlet region. Preferably, the urine collecting receptacle is formed having a closable air vent.

According to a preferred embodiment of the invention, the inlet and outlet of the valve, the outlet end of the first conduit and the inlet end of the second conduit are cooperatively formed so as to enable the first and second conduits to be quickly connected to, and disconnected from, the valve. To this end, the inlet and outlet of the valve are preferably formed having a female quick-disconnect fitting and the outlet end of the first fluid conduit and the inlet end of the second fluid conduit are then formed having male quick-disconnect fittings.

A screen may be disposed between the urine receiving member and the urine collecting receptacle, the screen being configured for catching and retaining foreign material, such as kidney stones, in the flow of urine from the receiving member to the urine collecting receptacle. Most preferably, the screen is disposed between the urine receiving member and the first conduit so as to be conveniently accessible.

In order to permit the easy collecting of a urine sample, the apparatus preferably includes a urine specimen container. This specimen container has means enabling the connection thereof to the outlet of the valve in place of the inlet end of the second conduit. When the outlet of the valve is formed having a female quick-disconnect, the inlet of the specimen container is formed having a mating male quick-disconnect fitting.

The portable urinal of the present invention is thus easy and convenient to use and is relatively inexpensive.

BRIEF DESCRIPTION OF THE DRAWINGS

The present invention can be more readily understood by a consideration of the following detailed description when taken in conjunction with the accompanying drawings, in which.

In the various FIGS. identical elements and features are given the same reference number.

DETAILED DESCRIPTION OF THE INVENTION

Figure 1:
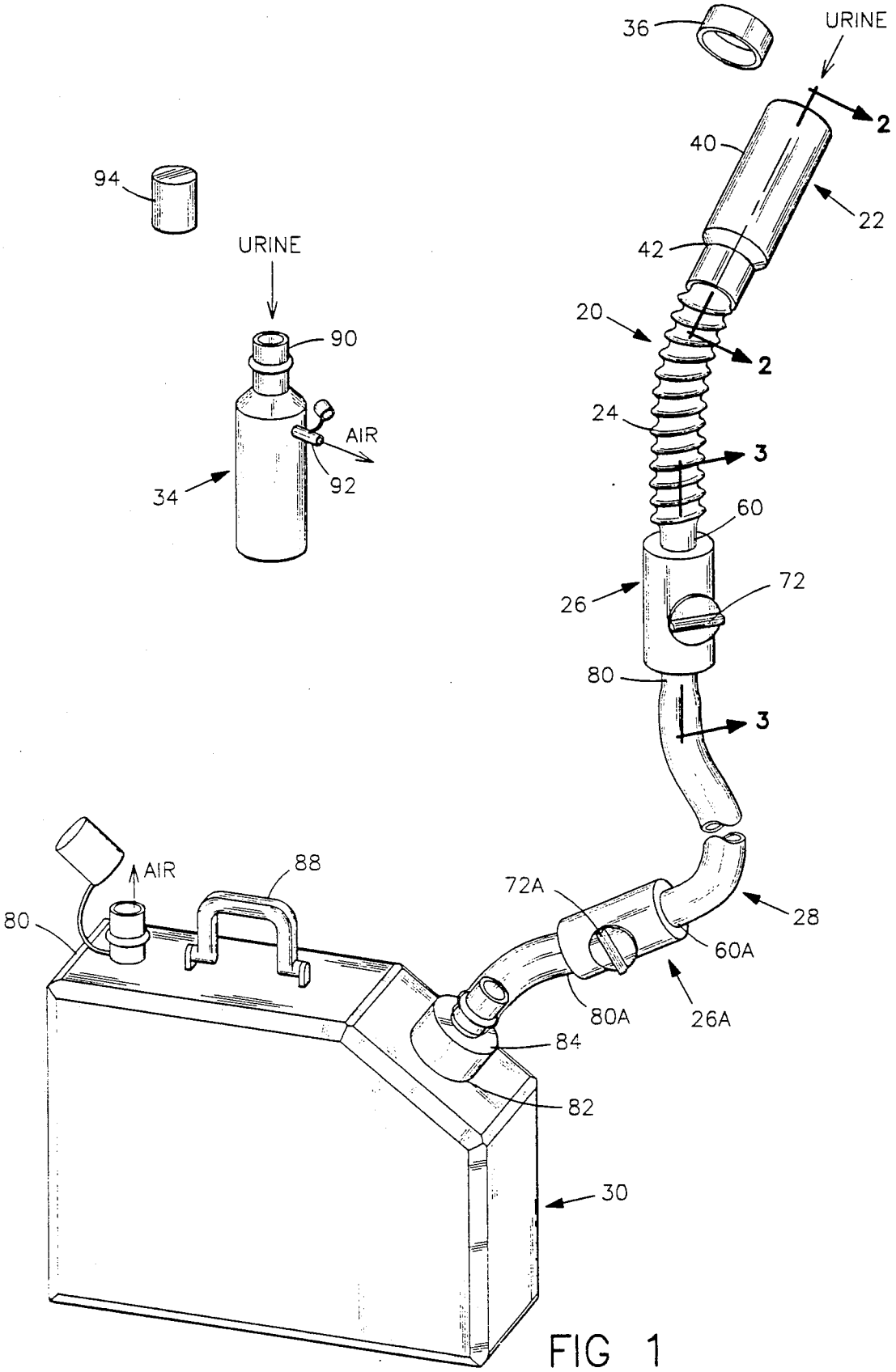
FIG. 1 is a perspective drawing of a portable urinal apparatus in accordance with the present invention, showing the construction and various parts thereof.

There is shown in FIG. 1 a portable urinal apparatus 20 in accordance with the present invention. Shown comprising portable urinal apparatus 20, as more particularly described below and connected in flow order, are a urine receiving member 22, a first flexible fluid (urine) conduit 24, a first shut-off valve 26, a second flexible fluid conduit 28, a second shut-off valve 26A, a third flexible fluid conduit 28A, and a urine collecting receptacle 30.

Preferable, but not necessarily, a urine specimen collector or bottle 34 is included in portable urinal apparatus 20 for enabling the collection of urine samples by use of the apparatus. A cap 36 is preferably provided for covering the open end of urine receiving member 20 when it is not being used or for storage.

Figure 2:
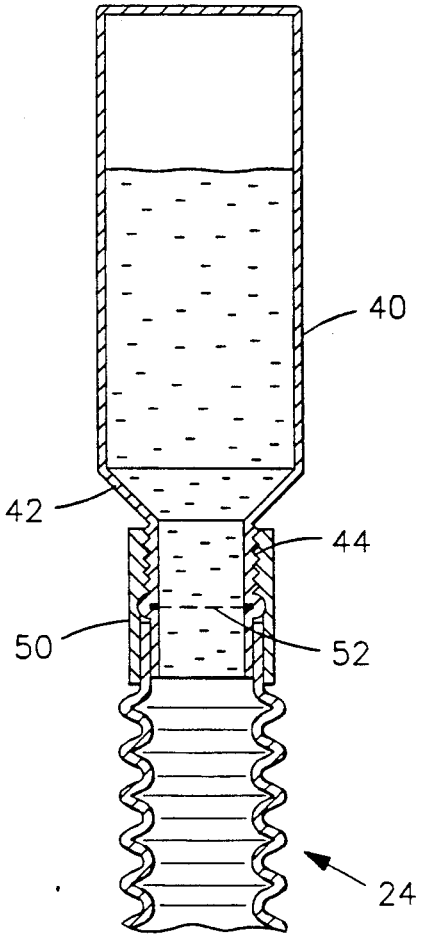
FIG. 2 is a longitudinal cross sectional view (shown in exploded form) looking along line 2—2 of FIG. 1, showing features of a urine inlet portion of the apparatus.

Urine receiving member 22 is preferably formed having a urine inlet region 40 that is generally circular in transverse cross section (FIG. 1) and that is terminated at the urine discharge end in a funnel-shaped region 42 that terminates in a male screw thread coupling half 44 (FIG. 2). First conduit 24 has, at its inlet end, a female threaded coupling half 50 that enables the first conduit to be detachably connected to the discharge end of urine receiving member 22. Coupling halves 44 and 50 may, for example, comprise conventional hose couplings. A gasket seal, for example, a conventional O-ring, is installed between coupling halves 44 and 50 to form a fluid-tight connection between member 22 and first conduit 24 upon assembly of apparatus 20.

Urine receiving member 22 is preferably constructed from a plastic, such as polyethylene, that can be easily cleaned and disinfected. Although member 22 is preferably a universal member, it can be provided in a variety of sizes and shapes depending upon whether the intended user is male or female or is a child or an adult; also, special configurations can be provided for special circumstances.

Preferably a screen is provided for catching and retaining foreign matter, such as kidney stones or portions thereof, in the user's urine, such screen being installed in apparatus 20 between urine receiving member 22 and urine collection receptacle 30. To this end, and as shown by way of example in FIG. 2, a small, cup-like mesh screen 52 (preferably constructed of a corrosion-resistant material, such as stainless steel) is installed between coupling halves 44 and 50 so as to be easily accessed by a user of portable urinal apparatus 20.

First fluid conduit 24 is preferably constructed of an accordion type flexible plastic material that is very flexible. In order to enable first conduit 24 to be readily connected to and disconnected from first valve 26, an outlet end of the conduit is preferably formed having a male quick-disconnect, snap-in fitting or coupling 60, as is known in the fluid conducting art (FIG. 3).

Figure 3:
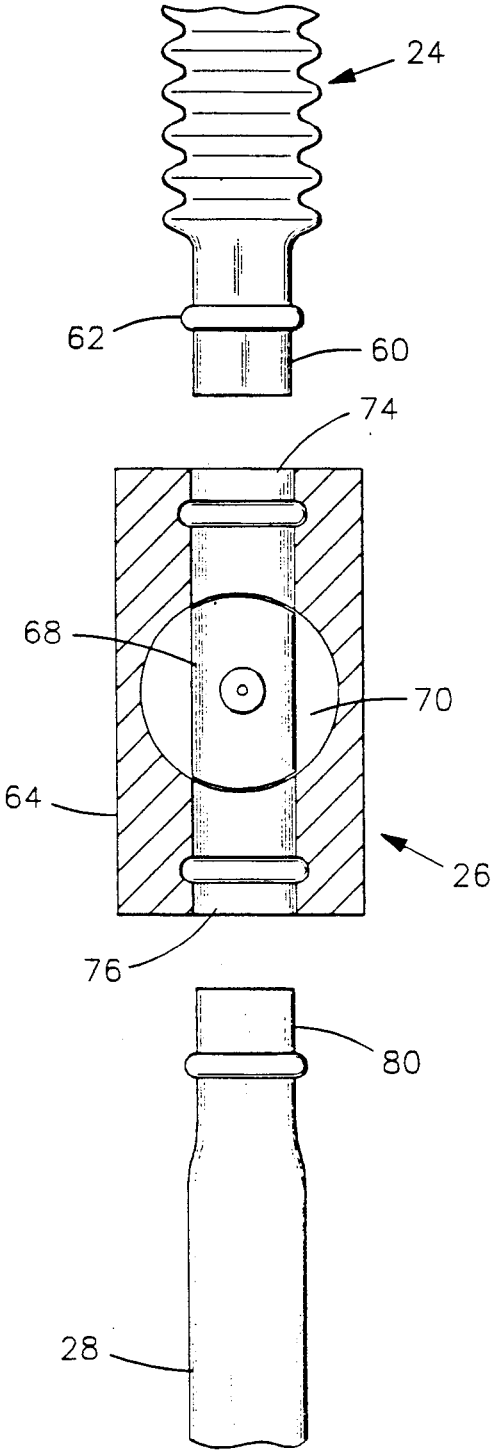
FIG. 3 is a longitudinal cross sectional view looking along line 3—3 of FIG. 1, showing features of a quick disconnect valve portion of the apparatus.

Valve 26, as best seen in FIG. 3, comprises a housing 64, preferably of plastic, having an internal, axial, flow channel 66. Installed in housing 64 in flow channel 66 is a cylindrical fluid shut-off element 68 that has a flow channel 70 formed therethrough, (FIG. 3) and a flow blocking, off position in which the element channel is out of flow communication with the housing channel. Suitable seals (not shown) are provided, as is known in the art, between housing 64 and valve element 68 to prevent leakage from valve 26.

An inlet 74 and an outlet 76 of valve housing 64 are internally formed as a female quick-disconnect coupling that mates with the outlet end male quick-disconnect fitting 60 of first conduit 24 (FIG. 3).

Second flexible fluid conduit 28, which may be from several inches to several feet long and constructed out of the same type of plastic as first conduit 24, is formed having a male quick-disconnect fitting 80 that snaps into mating female quick-disconnect fitting portion 76 of first valve 26 (FIG. 3).

Second shut-off valve 26A is similar to, and preferably identical to, above-described first valve 26. A male quick disconnect end 60A of second conduit 28 mates with an internal, female quick disconnect fitting at an inlet end (corresponding to inlet end 74 of first valve 26) of second valve 26A. An outlet end (corresponding to outlet end 76 of first valve 26) is also formed having a female quick disconnect fitting.

An inlet end region 80A of third conduit, which may be from several inches to several feet long, is formed having a male quick disconnect fitting similar to inlet end 80 of second conduit 28.

Urine collecting receptacle 30, to an inlet region 82 of which an outlet coupling end 84 of third fluid conduit 28A is detachably connected, may be of any convenient form. However, in FIG. 1, receptacle 30 is shown, for convenience and low cost, as being a conventional two-gallon plastic gasoline container such as can be purchased in hardware stores and at many service stations for several dollars. Preferably, receptacle 30 is formed having a closable air vent 86 and a convenient carrying handle 88. It is, of course, to be appreciated that other types of receptacles can alternatively be used.

Specimen container 34 is preferably, but not necessarily, included as part of portable urinal apparatus 30 to enable the convenient taking of urine specimens for urinalyses, as may be required for many types of individuals that would use the apparatus. In such case, an inlet end 90 of container 34 is formed with a male quick-disconnect fitting identical to inlet fitting 80 of second conduit 28. Accordingly, container can be snapped into female fitting 76 of first valve 26 in place of second conduit 26. Specimen container 34 is preferably formed having a small, closable air outlet 92 at the top thereof (FIG. 1). A snap-on cap 94 is provided for closing container 34 after a urine specimen has been received in the container. Valve 26 is especially helpful in preventing overflow when a specimen is collected in specimen container 34.

As an alternative to the use of specimen container 34, a urine sample can be collected in second conduit 28 between first and second shut-off valves 26 and **26*a*, such valves being closed to trap the sample in the conduit. The entire assembly comprising first and second valves 26 and 26A and second conduit 28 can then be disconnected from first and third conduits 24 and 28A and be emptied into a suitable specimen container (not shown), after which the assembly is reconnected between conduits 24 and 28A**.

As shown and described above, portable urinal apparatus 20 is convenient to use and is constructed so as to be inexpensive to make.

Although there has been described and illustrated a portable urinal apparatus in accordance with the present invention for purposes of illustrating the manner in which the invention may be used to advantage, it is to be appreciated that the invention is not limited thereto. Therefore, any and all variations and modifications that may occur to those skilled in the art are to be considered as being within the scope and spirit of the claims as appended hereto.

What is claimed is:

1. A portable urinal system which comprises:

(a) a urine-receiving member having an inlet and an outlet, said inlet being sized and shaped for receiving a flow of urine from an individual using the apparatus;

(b) a first flexible fluid conduit having an inlet end and an outlet end, the inlet end being detachably connected to the outlet of said urine receiving member;

(c) a first valve having an inlet and an outlet, said inlet being connected to the outlet end of the first flexible conduit;

(d) a second flexible fluid conduit having an inlet end and an outlet end, the inlet end of said second conduit being detachably connected to the outlet of said first valve;

(e) a second valve having an inlet and an outlet, said inlet being connected to the outlet end of the second flexible conduit, a relatively small, detachable urine container being thereby formed by said first and second valves and said second conduit;

(f) a third flexible fluid conduit having an inlet end and an outlet end, the inlet end of said third conduit being detachably connected to the outlet of said second valve;

(g) a urine collecting receptacle having a fluid inlet region, the outlet end of said third conduit being detachably connected to said receptacle fluid inlet region; and (h) a separate urine specimen container, said container having means enabling the connection thereof to the outlet of said first valve in place of the inlet end of said second conduit.

2. The portable urinal system as claimed in claim 1, wherein the inlet of said first valve, the outlet end of the first conduit, the outlet of said second valve and the inlet of said third conduit are formed so as to enable said relatively small urine container to be quickly detached from and reconnected between said first and third conduits.

* * * * *